US005780799A

United States Patent [19]

David

[11] Patent Number: 5,780,799

[45] Date of Patent: Jul. 14, 1998

[54] REDUCED AUTOCOMPRESSION CIRCUIT-BREAKER

[75] Inventor: Renaud David, Chuzelles, France

[73] Assignee: GEC Alsthom T & D SA, Paris, France

[21] Appl. No.: 813,090

[22] Filed: Mar. 7, 1997

[30] Foreign Application Priority Data

Mar. 11, 1996 [FR] France ..... 96 03033

[51] Int. Cl.[6] ..... H01H 33/14; H01H 33/88; H01H 9/30

[52] U.S. Cl. ..... 218/57; 218/7; 218/154; 218/84

[58] Field of Search ..... 218/7, 43, 45, 218/50, 57, 59, 60, 61, 58, 78, 84, 120, 140, 153, 154, 67

[56] References Cited

FOREIGN PATENT DOCUMENTS

0591039A1 4/1994 European Pat. Off. .

3201646A1 12/1982 Germany .

667943A5 11/1988 Switzerland .

*Primary Examiner*—Vit W. Miska

*Assistant Examiner*—Michael J. Hayes

*Attorney, Agent, or Firm*—Sughrue, Mion, Zinn, Macpeak & Seas, PLLC

[57] ABSTRACT

This present invention concerns a circuit-breaker of the self-blasting type including a system for immobilizing the semi-mobile piston during a first part of displacement of the mobile contact assembly between the closed position and the open position and for displacing the piston axially during a second portion of the same displacement of the mobile contact assembly. This system includes at least one first longitudinal slot and at least one second longitudinal slot on the fixed tube, a freely rotatable locking tube carried by the fixed tube, aligned with the slots thereof and including at least one first longitudinal slot and at least one second longitudinal slot, at least one pin carried by the second tube and penetrating the first slot of the fixed tube and the first slot of the locking tube, and at least one pin carried by the piston and penetrating the second slot of the fixed tube and the second slot of the locking tube.

8 Claims, 6 Drawing Sheets

REDUCED AUTOCOMPRESSION CIRCUIT-BREAKER

BACKGROUND OF THE INVENTION

1. Field of the invention

The invention concerns a reduced autocompression circuit-breaker.

2. Description of the prior art

To be more precise, the invention concerns a circuit-breaker of the self-blasting type comprising a jacket filled with a pressurized dielectric gas, two cooperating arc contacts at least one of which is part of a mobile contact assembly attached to a maneuvering member and adapted to be displaced axially in the jacket between a closed position and an open position, and vice versa, the mobile contact assembly comprising a first tube carrying the mobile arc contact at its end and a second tube coaxial with the first tube to delimit on respective opposite sides of a ring joining the first and second tubes a constant volume expansion chamber closed by a blast nozzle and a compression chamber communicating with the expansion chamber and closed by a semi-mobile piston, the second tube sliding in a fixed tube and the circuit-breaker including means for immobilizing the piston during a first part of displacement of the mobile contact assembly between the closed position and the open position and for displacing the piston axially during a second portion of the displacement of the mobile contact assembly and an arrangement for coupling the second tube and the piston during the second part of the movement.

A circuit-breaker of the above kind is described in patent application FR-2 696 274.

In the above prior art document, first means for displacing the piston axially comprise an entrainment member fastened to the mobile contact assembly which during the second part of the movement of the mobile contact assembly entrains an abutment disposed on the path of the entrainment member fastened to the piston. The piston is coupled to a third tube provided with at least one opening in which slides a finger fastened to the first tube and extending radially relative to the first tube towards the second tube. Second means for immobilizing the piston comprise a spring disposed between the entrainment member and the piston and a fixed retaining member cooperating with the piston.

In an arrangement of this kind the spring urging the semi-mobile piston applies a permanent force to the operating link and increases the operating energy required.

The aim of the invention is to provide a circuit-breaker with low operating energy by virtue of a specific arrangement of said means which also has the advantage of being more compact.

SUMMARY OF THE INVENTION

To this end, in accordance with the invention, said means comprise:

- at least one first longitudinal slot and at least one second longitudinal slot on said fixed tube,
- a freely rotatable locking tube carried by said fixed tube, aligned with said slots thereof and including at least one first longitudinal slot and at least one second longitudinal slot,
- at least one pin carried by said second tube and penetrating said first slot of said fixed tube and said first slot of said locking tube,
- at least one pin carried by said piston and penetrating said second slot of said fixed tube and said second slot of said locking tube,

- said slots being shaped to immobilize said piston during said first part of said movement and to procure axial movement of said piston during said second part of said movement.

The arrangement in accordance with the invention adds less weight to the mobile assembly and does not include any spring or link. The operating energy required is therefore only slightly increased compared to a fixed piston circuit-breaker.

The arrangement of the invention also achieves accurate and clean positioning of the semi-mobile piston without any rebound such as occurs in arrangements using springs.

In a first embodiment, said coupling arrangement comprises at least one retractable ball carried by the piston and adapted to cooperate with a shoulder carried by the first tube.

In a second embodiment, the coupling arrangement comprises a pin carried by the piston and adapted to engage with a notch in the second tube, said slots being shaped to procure relative rotation of the second tube and the piston at the end of said first part of said movement.

Advantageously, in either embodiment, the fixed tube and the locking tube comprise a plurality of first and second slots, the second tube and the piston carrying a corresponding number of pins.

The invention is described in more detail hereinafter with the aid of figures showing one preferred embodiment of the invention.

DETAILED DESCRIPTION OF THE PREFERRED EMBODIMENTS

Figure 1:
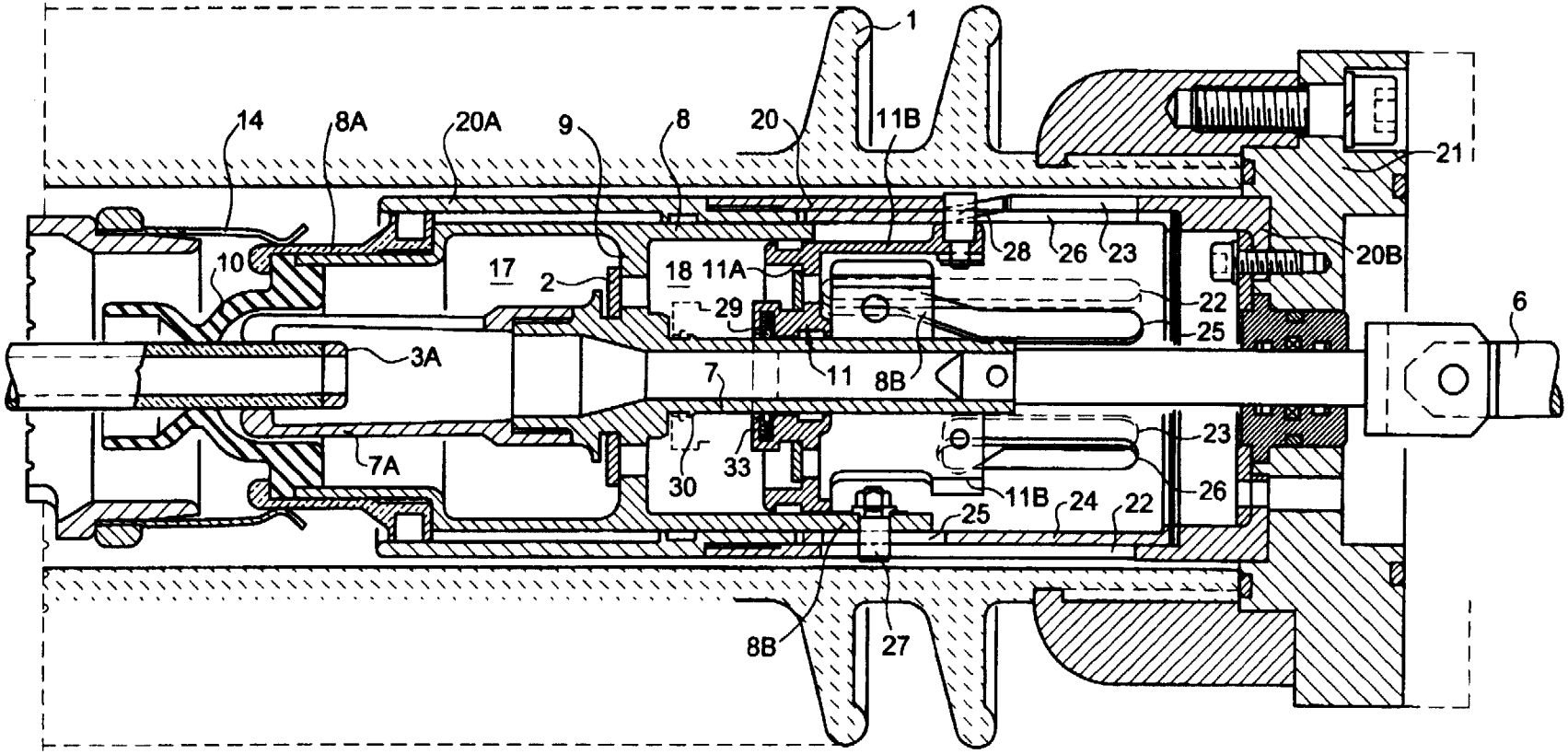
FIG. 1 is a view in longitudinal section of a first embodiment of a circuit-breaker of the invention.

A first embodiment of the invention is shown in FIG. 1.

The circuit-breaker shown in the figures conventionally comprises a jacket, for example an insulative jacket 1 filled with a pressurized dielectric gas, two arc contacts 3A, 7A cooperating with each other, at least one of them being part of a mobile contact assembly attached to an operating member 6 and adapted to be axially displaced in the jacket 1 between a closed position and an open position and vice versa, the mobile contact assembly comprising a first tube 7 carrying the mobile arc contact 7A at its end and a second tube 8 coaxial with the first tube 7, to delimit, on either side of a ring 9 linking the first and second tubes, a constant volume expansion chamber 17 closed by a blast nozzle 10 and a compression chamber 18 communicating via a one-way valve 2 with the expansion chamber and closed by a semi-mobile piston 11. The circuit-breaker may further include a fixed permanent contact 14 cooperating with a mobile permanent contact 8A carried by the second tube 8. The second tube 8 slides in a fixed tube 20, 20A constructed for assembly reasons from two tubes screwed together and fixed by a flange 20B to a back plate 21 of the circuit-breaker.

The circuit-breaker also includes an arrangement for coupling the second tube 8 and the piston 11 during the second part of the opening movement and during closing. This coupling arrangement comprises at least one retractable ball 29 carried by the piston 11 and cooperating with a shoulder 30 carried by the first tube 7. The ball 29 is pushed against the first tube 7 by a spring 33 accommodated inside an arm carried by the piston 11.

The circuit-breaker includes means for immobilizing the piston during a first part of the movement of the mobile contact assembly between the closed position and the open position and for procuring axial movement of the piston during a second part of this same movement of the mobile contact assembly.

These means comprise:

- at least one first longitudinal slot 22 and at least one second longitudinal slot 23 on the fixed tube 20,
- a freely rotatable locking tube 24 carried by the fixed tube 20, aligned with the slots 22, 23 of the latter and including at least one first longitudinal slot 25 and at least one second longitudinal slot 26,
- at least one pin 27 carried by the second tube 8 and penetrating the first slot 22 of the fixed tube 20 and the first slot 25 of the locking tube 24, and
- at least one pin 28 carried by the piston 11 and penetrating the second slot 23 of the fixed tube 20 and the second slot 26 of the locking tube 24.

The second tube 8 has arms 8B, for example three such arms, at the end opposite the contacts, arranged around its perimeter and each carrying a pin 27 adapted to be introduced into the respective first slots 22 and 25 on the fixed tube 20 and on the locking tube 24.

The piston 11 has an annular compression part 11A and arms 11B, for example three such arms, arranged around the perimeter of the annular part 11A and each carrying a pin 28 adapted to be introduced into the respective second slots 23 and 26 on the fixed tube 20 and on the locking tube 24.

Said slots are shaped to immobilize the piston 11 during said first part of the movement and to procure axial movement of the piston 11 during said second part of the same movement.

To this end the slots are shaped as shown in FIGS. 2A through 2C, FIG. 3 being a fragmentary view in cross-section at each pin 27, 28 corresponding to the closed position of the circuit-breaker.

Figure 2A:
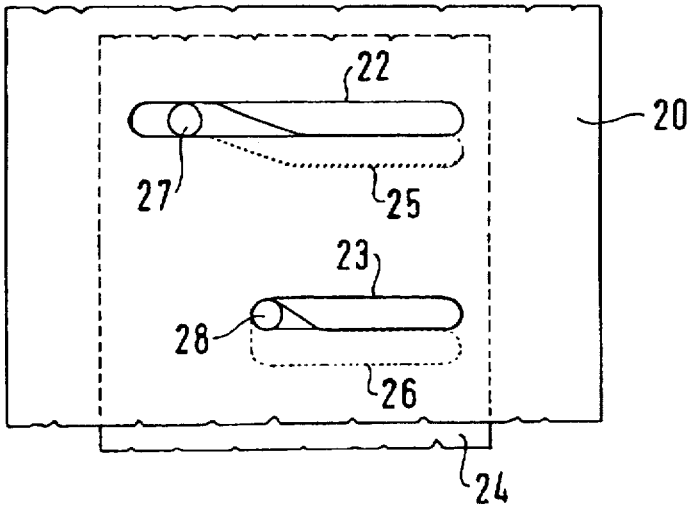
FIGS. 2A through 2C are fragmentary views of this circuit-breaker during opening.
Figure 2B:
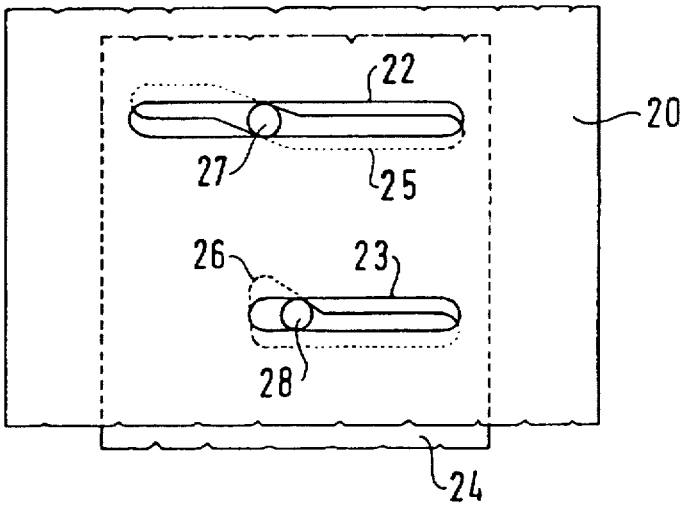
Figure 2C:
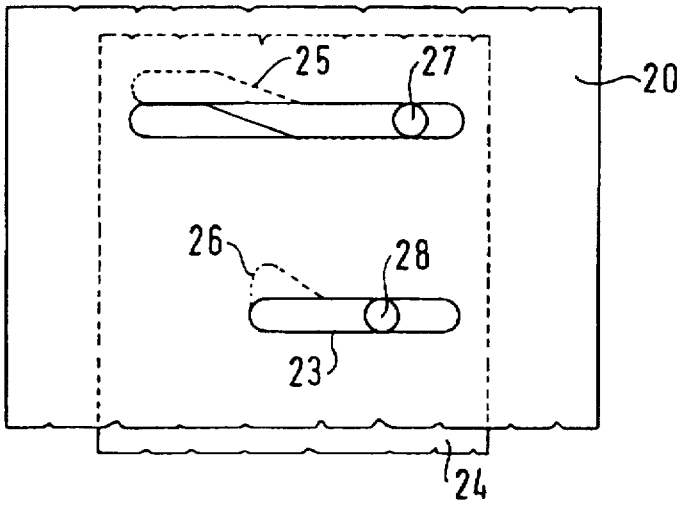
Figure 3:
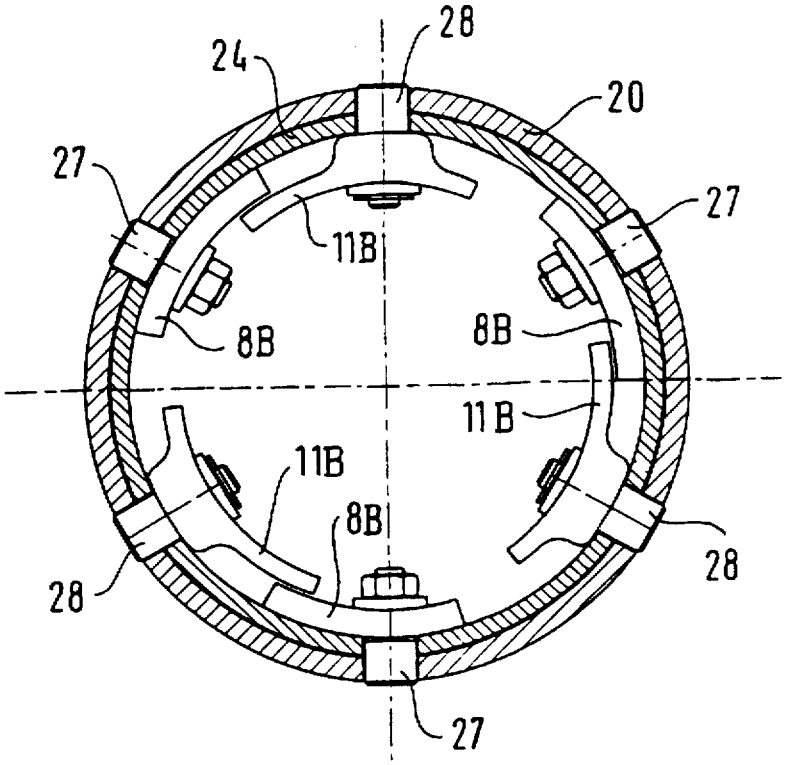
FIG. 3 is a fragmentary view of this circuit-breaker in cross-section in the closed position.

FIGS. 2A and 3 show the circuit-breaker closed; in FIG. 2B, the contacts have completed said first part of the movement; in FIG. 2C, the contacts have completed said second part of the movement and are in the open position.

The first slot 22 of the fixed tube 20 is straight and parallel to the longitudinal axis of the circuit-breaker and the first slot 25 of the locking tube 24 has two straight sections parallel to the longitudinal axis of the circuit-breaker linked by an inclined section.

The second slot 23 of the fixed tube 20 is a shorter straight section parallel to the longitudinal axis of the circuit-breaker and the second slot 26 of the locking tube 24 is a straight section parallel to the longitudinal axis of the circuit-breaker widened by a laterally inclined section at the end.

As shown in FIG. 2A, in the closed position the pin 27 carried by the second tube 8 is near the end of the first slot 22, 25. The pin 28 is at the end of the longitudinal section of the second slot 23 of the fixed tube 20 and in the inclined section of the second slot 26 of the locking tube 24.

Upon opening, the mobile assembly entrained by the link 6 and therefore the second tube 8 are moved in translation. The pin 27 of the latter is therefore moved in translation in the first slots 22 and 25.

During the first part of the movement, which is along the first longitudinal slot 22 and the first longitudinal section of the first slot 25, the locking tube 24 cannot rotate and the pin 28 of the piston 11 remains locked at the end of the second slot 26 of the second tube 8. The piston 11 therefore remains fixed and the gas is compressed in the compression chamber 18 to the maximum compression corresponding to the position shown in FIG. 2B.

In this position, the pin 27 continues to move in translation and because of the inclined section of the first slot 25 of the locking tube 24, the latter is entrained in rotation, so releasing the pin 28 of the piston 11 which can move in the second slot 26 of the second tube 8, which initiates relative movement of the piston 11 towards the right (as seen in FIG. 1), without relative rotation of the second tube 8 and of the piston 11. In this position the pin 28 of the piston 11 enters the longitudinal section of the second slot 26 of the locking tube 24.

At the end of this first opening movement, the shoulder 30 meets the ball 29 which clips into place on the lefthand side of the shoulder 30 (as seen in FIG. 1).

The second tube 8 with the piston 11 continues its opening travel until it reaches the open position shown in FIG. 2C. The pin 27 of this tube 8 moves in the first longitudinal slots 22, 25 which are superposed at this time and the pin 28 of the piston 11 moves in the second longitudinal slots 23, 26 which are superposed at this time. The second tube 8 and the piston 11 are locked together.

The clipping of the ball 29 onto the shoulder 30 assures entrainment of the piston 11 by the mobile assembly upon the closing movement of the circuit-breaker until the pin 28 of the latter abuts against the lefthand end (as seen in FIG. 1) of the second slots 23, 26.

This first embodiment has been described with only one first slot and only one second slot, but to achieve reliable guidance without jamming the fixed tube 20 and the locking tube 24 include a plurality of first and second slots 22, 23, 25, 26, the second tube 8 and the piston 11 carrying a corresponding number of pins 27, 28 as indicated above.

Figure 4:
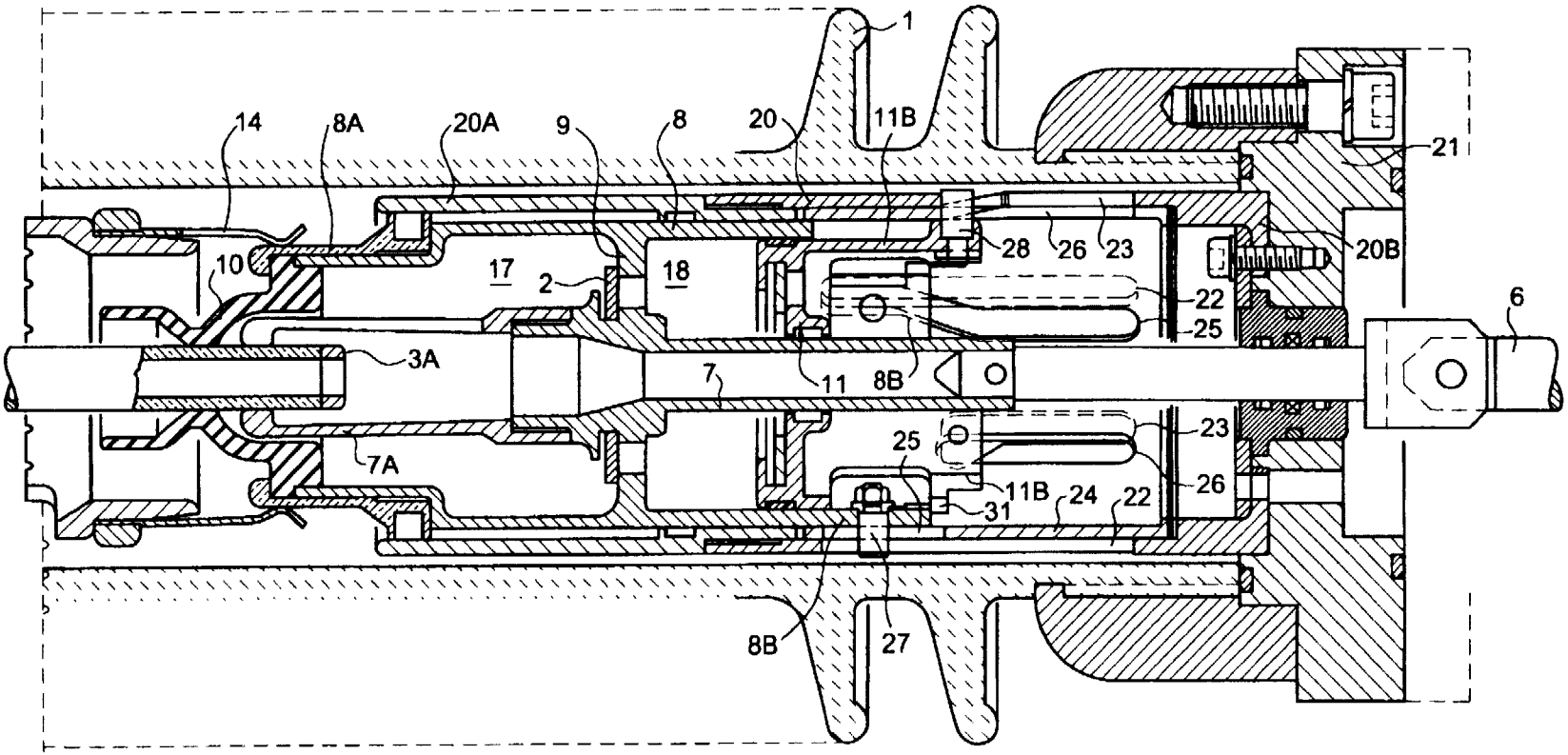
FIG. 4 is a view in longitudinal section of a second embodiment of a circuit-breaker of the invention.

FIG. 4 shows a second embodiment of the invention which differs from the previous one in that the arrangement coupling the second tube 8 and the piston 11 on closure is no longer a retractable ball system 29, which is dispensed with in this embodiment, but instead a conformation of the arms 8B, 11B adapted to fasten the second tube 8 and the piston 11 together during opening, to be more precise at the commencement of said second part of the movement, by means of a lug 31 carried by the arms 11B of the piston 11 and engaging with a notch 32 in the arms 8B of the second tube 8.

The second tube 8 has the arms 8B, for example three such arms, at the end opposite the contacts, distributed around its perimeter and each carrying the pin 27 adapted to be introduced into the respective first slots 22 and 25 on the fixed tube 20 and on the locking tube 24 and a notch 32 adapted to cooperate with a lug 31 on the arms 11B of the piston 11 during opening.

The piston 11 includes the annular compression part 11A and the arms 11B, for example three such arms, arranged around the perimeter of the annular part 11A and each carrying the pin 28 adapted to be introduced into the respective second slots 23 and 26 on the fixed tube 20 and on the locking tube 24 and also the lug 31.

Said slots are shaped to immobilize the piston 11 during said first part of the movement and to procure axial movement of the piston 11 with the mobile assembly during said second part of the same movement by virtue of the fastening together of the piston 11 and the second tube 8 during opening.

To this end, the slots are shaped as shown in FIGS. 5A through 5C, FIGS. 6A through 6C showing corresponding fragmentary views in cross-section at each pin 27, 28.

Figure 5A:
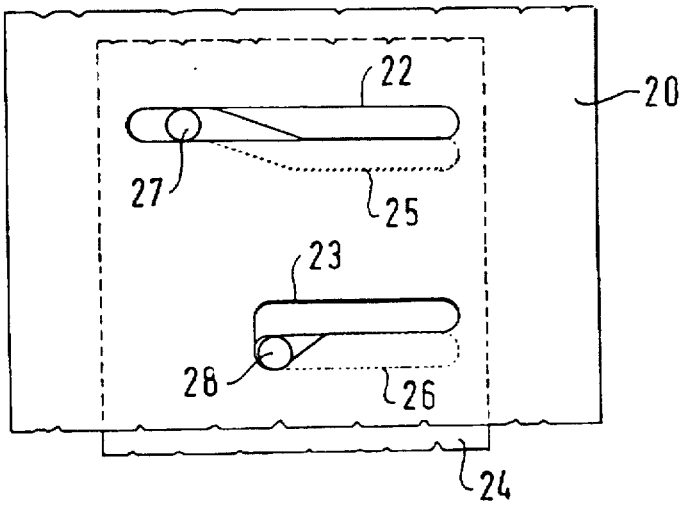
FIGS. 5A through 5C are fragmentary views of this circuit-breaker during opening.
Figure 5B:
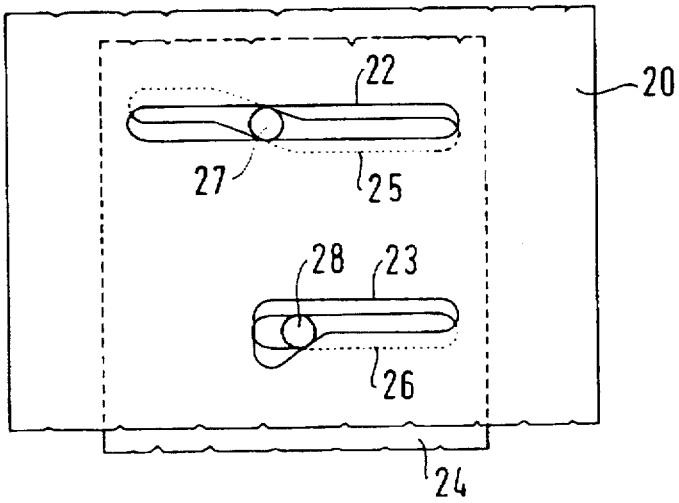
Figure 5C:
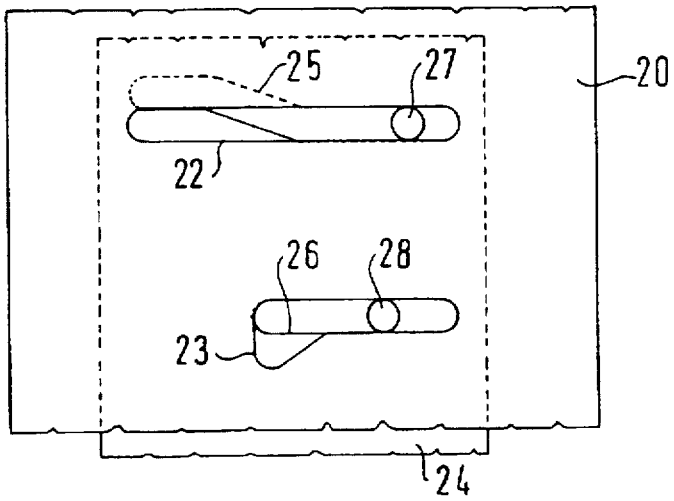
Figure 6A:
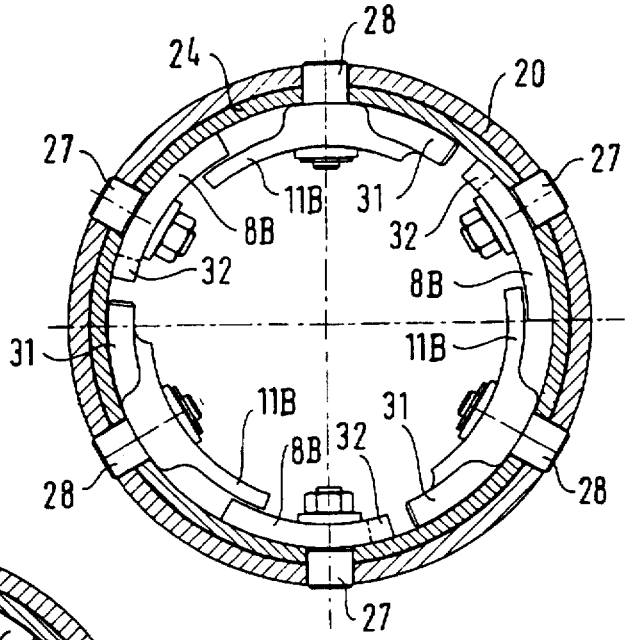
FIGS. 6A through 6C are corresponding fragmentary views in cross-section of this circuit-breaker.
Figure 6B:
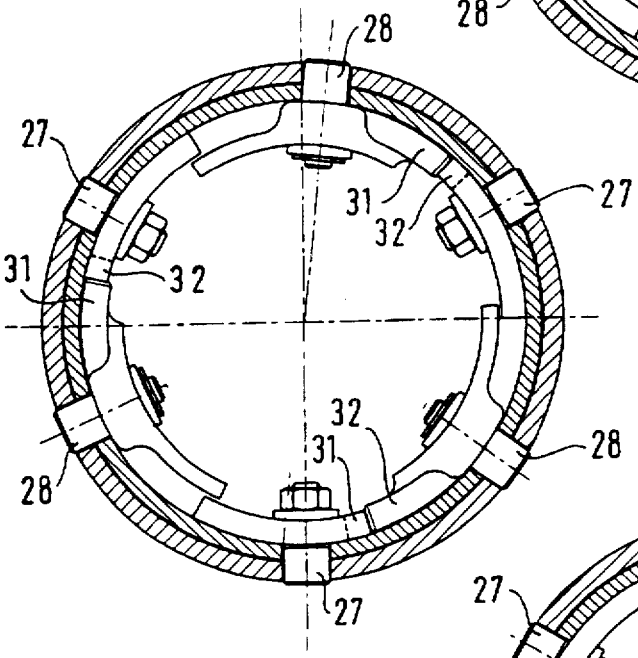
Figure 6C:
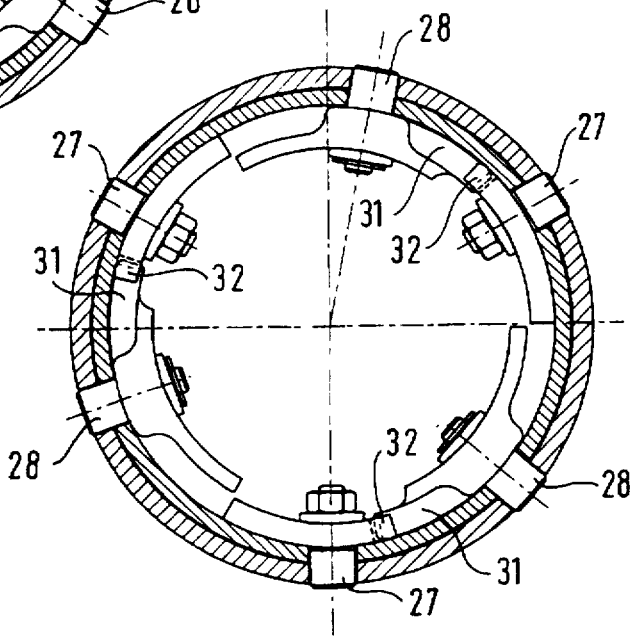

In FIGS. 5A and 6A the circuit-breaker is closed; in FIGS. 5B and 6B the contacts have completed said first part of the movement; in FIGS. 5C and 6C the contacts have completed said second part of the movement and are in the open position.

The first slot 22 of the fixed tube 20 is straight and parallel to the longitudinal axis of the circuit-breaker and the first slot 25 of the locking tube 24 has two straight sections parallel to the longitudinal axis of the circuit-breaker joined by an inclined section.

The second slot 23 of the fixed tube 20 is a shorter straight section parallel to the longitudinal axis of the circuit-breaker and widened by a laterally inclined section at the end and the second slot 26 of the locking tube 24 is a straight section parallel to the longitudinal axis of the circuit-breaker.

As shown in FIG. 5A, in the closed position, the pin 27 carried by the first tube 8 is near the end of the first slots 22, 25. The pin 28 is at the end of a longitudinal section of the second slot 26 of the second tube 8 and in the inclined section of the second slot 23 of the fixed tube 20.

During opening, the mobile assembly entrained by the link 6 and therefore the second tube 8 are moved in translation. The pin 27 of the latter is therefore moved in translation in the first slots 22 and 25.

In the first part of the movement, along the first longitudinal slot 22 and the first longitudinal section of the first slot 25, the locking tube 24 cannot rotate and the pin 28 of the piston 11 remains locked at the end of the second slot 26 of the second tube 8. The piston 11 therefore remains fixed and the gas is compressed in the compression chamber 18 to the maximum compression corresponding to the position shown in FIG. 5B.

In this position the pin 27 continues to move in translation and because of the inclined section of the first slot 25 of the locking tube 24, the latter is entrained in rotation, so releasing the pin 28 of the piston 11 which can therefore move in the second slot 26 of the second tube 8, which initiates relative movement of the piston 11 towards the right (as seen in FIG. 1), with relative rotation of the second tube 8 and of the piston 11. In this position the pin 28 of the piston 11 enters the longitudinal section of the second slot 23 of the fixed tube 20.

On rotation of the piston 11 by the pin 28, the lugs 31 of the arms 11B of the latter are introduced into the notches 32 of the arms 8B of the second tube 8 as can be seen in FIG. 6C. The piston 11 is then attached to the second tube 8 and therefore to the mobile assembly.

The second tube 8 together with the piston 11 continues its opening travel as far as the open position shown in FIG. 5C. The pin 27 of the tube 8 moves in the first longitudinal slots 22, 25 which are superposed at this time and the pin 28 of the piston 11 moves in the longitudinal second slots 23, 26 which are superposed at this time.

The lugs 31 assure that the piston 11 is entrained by the mobile assembly during the closure movement of the circuit-breaker.

There is claimed:

1. A circuit-breaker of the self-blasting type comprising a jacket filled with a pressurized dielectric gas, two cooperating arc contacts at least one of which is part of a mobile contact assembly attached to a maneuvering member and adapted to be displaced axially in the jacket between a closed position and an open position, and vice versa, the mobile contact assembly comprising a first tube carrying the mobile arc contact at its end and a second tube coaxial with the first tube to delimit on respective opposite sides of a ring joining the first and second tubes a constant volume expansion chamber closed by a blast nozzle and a compression chamber communicating with the expansion chamber and closed by a semi-mobile piston, the second tube sliding in a fixed tube and the circuit-breaker including means for immobilizing the piston during a first part of displacement of the mobile contact assembly between the closed position and the open position and for displacing the piston axially during a second portion of the displacement of the mobile contact assembly and an arrangement for coupling the second tube and the piston during the second part of the movement, wherein said means comprise:

at least one first longitudinal slot and at least one second longitudinal slot on said fixed tube, a freely rotatable locking tube carried by said fixed tube, aligned with said slots thereof and including at least one first longitudinal slot and at least one second longitudinal slot, at least one pin carried by said second tube and penetrating said first slot of said fixed tube and said first slot of said locking tube, at least one pin carried by said piston and penetrating said second slot of said fixed tube and said second slot of said locking tube, said slots being shaped to immobilize said piston during said first part of said movement and to procure axial movement of said piston during said second part of said movement.

2. The circuit-breaker claimed in claim 1 wherein said coupling arrangement comprises at least one retractable ball carried by said piston and adapted to cooperate with a shoulder carried by said first tube.

3. The circuit-breaker claimed in claim 1 wherein said coupling arrangement comprises a lug carried by said piston and adapted to engage with a notch in said second tube, said slots being adapted to procure relative rotation of said second tube and said piston at the end of said first part of said movement.

4. The circuit-breaker claimed in claim 2 wherein said first slot of said fixed tube is straight and parallel to a longitudinal axis of said circuit-breaker and said first slot of said locking tube has two straight sections parallel to said longitudinal axis of said circuit-breaker and linked by an inclined section.

5. The circuit-breaker claimed in claim 2 wherein said second slot of said fixed tube is a straight section parallel to a longitudinal axis of said circuit-breaker and said second slot of said locking tube is a straight section parallel to said longitudinal axis of said circuit-breakers and widened by a laterally inclined section at the end.

6. The circuit-breaker claimed in claim 3 wherein said first slot of said fixed tube is straight and parallel to a longitudinal axis of said circuit-breaker and said first slot of said locking tube has two rectilinear sections parallel to said longitudinal axis of said circuit-breaker and linked by an inclined section.

7. The circuit-breaker claimed in claim 3 wherein said second slot of said fixed tube is a straight section parallel to a longitudinal axis of said circuit-breaker and widened by a laterally inclined section at the end and said second slot of said locking tube is the straight section parallel to said longitudinal axis of said circuit-breaker.

8. The circuit-breaker claimed in claim 1 wherein said fixed tube and said locking tube comprise a plurality of first and second slots, said second tube and said piston carrying a corresponding number of pins.

* * * * *